United States Patent [19]

Tino

[11] 4,267,607

[45] May 19, 1981

[54] BODY GARMENT

[76] Inventor: Al Tino, 15 W. 38th St., New York, N.Y. 10018

[21] Appl. No.: 111,098

[22] Filed: Jan. 10, 1980

[51] Int. Cl.[3] ..... A41B 9/04

[52] U.S. Cl. ..... 2/409; 66/177

[58] Field of Search ..... 2/409, 239, 241, 227; 66/177

[56] References Cited

U.S. PATENT DOCUMENTS

| | | | |
|---|---|---|---|
| Re. 25,360 | 3/1963 | Rice | 2/409 |
| 1,898,001 | 2/1933 | Carmer | 2/241 X |
| 3,798,677 | 3/1974 | Brown et al. | 2/409 |
| 3,852,827 | 12/1974 | Colbert, Jr. | 2/409 |

*Primary Examiner*—H. Hampton Hunter

*Attorney, Agent, or Firm*—Arthur T. Fattibene

[57] ABSTRACT

A body garment construction comprising a unitary pants portion having connected leg portions that are integrally connected and whereby the respective leg portions are each made with an integrally formed reinforcing band adapted to circumscribe an intermediate portion of a wearer's thighs and which reinforcing band is positioned to provide a reinforced area for grasping the leg portion to facilitate the stretching and fitting of the leg portions to the wearer's legs in putting the garment on and which reinforced band, when the garment is fitted to the wearer, imparts a highly desirable fashionable simulation of a hose-dressed leg. The reinforced thigh band is integrally formed to the pants portion and leg portion by the utilization of a yarn having denier greater than that of the leg portion and/or pants portion.

2 Claims, 1 Drawing Figure

BODY GARMENT

PROBLEM AND PRIOR ART

Figure 1:
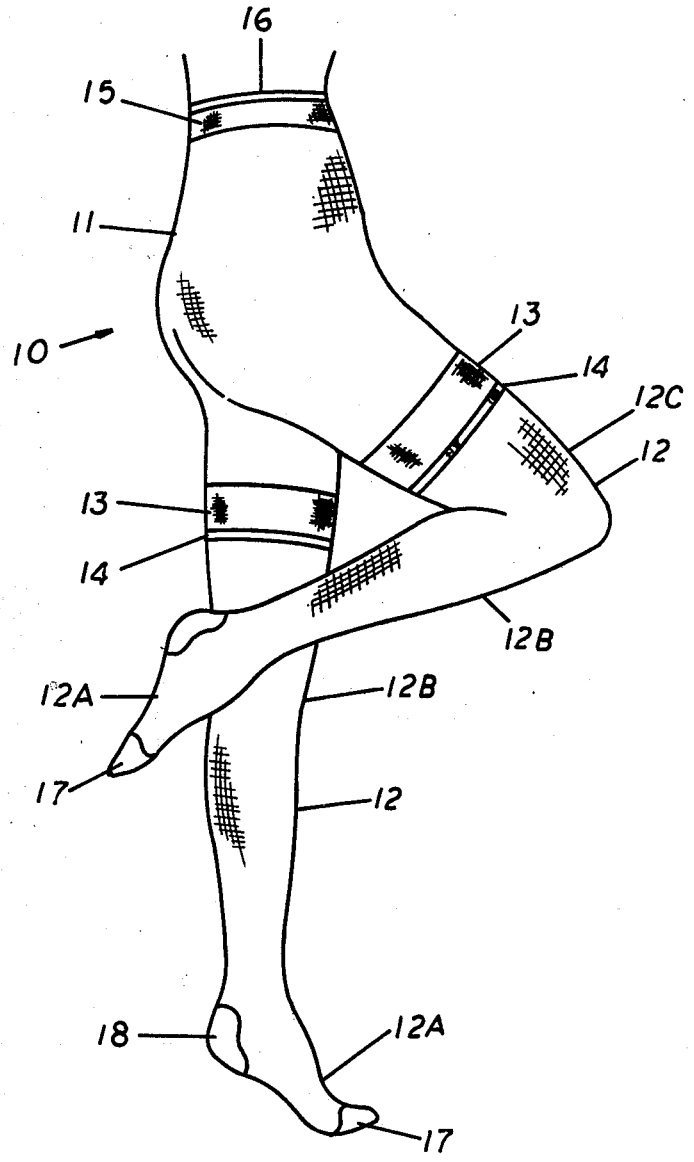

Numerous constructions of body garments frequently referred to as a panty hose are known. Generally, such garments comprise a pants portion having connected leg portions wherein the leg portions which cover the leg and thigh are formed of a unitary length made of the same denier yarn which imparts a similar sheer appearance to the entire leg portion of the garment and which sheer appearance continues into the pants portion of the garment Such garments are made and sold in limited standard sizes such as small, medium and large. For this reason, a given size is adapted to fit a number of differently built persons coming within the range of the particular standard size. As such body garments or panty hose are designed to snugly conform to one's body, the garment must be pulled and tugged and stretched to conform to the body of the wearer. In fitting such garment to the wearer, the wearer must first stretch the leg portions to shape the leg portions of the garment to her own legs. This requires the wearer to grasp the leg portion of the garment and stretch the same over her leg. Because the known leg and thigh portion of a panty hose are formed of a similar sheer denier yarn there is no particular area of desired strength for the wearer to grasp in fitting the panty hose to her body. For this reason, the wearer must carefully grasp the sheer portion of the leg portion of the garment and gently shape the garment to her leg. As the wearer of such garments generally have long and trim nails, great care must be exercised. Despite such care, it frequently happens that a wearer will snag and cause a "run" in fitting such garments to her body.

The known panty hose, because they are formed of yarn of constant sheer denier in the leg and thigh portions, also do not provide the desired fashion simulation of a hose-dressed leg. Frequently, because of the styling of one's outer garments a wearer may desire to complement such styles with a leg dress simulating a fashionable hose. The known body stockings or panty hose are not made to simulate any such fashionable or complementary leg dress and, accordingly, the known panty hose construction will not complement certain fashionable outer garments to give the wearer the total desired look she wishes to achieve.

OBJECTS

An object of this invention is to provide an improved panty hose construction formed with a reinforced band located so as to facilitate the wearer in fitting the leg portion of the garment to her own legs.

Another object is to provide an improved panty hose construction in which the reinforced portion imparts a highly desirable fashionable appeal to the panty hose.

Another object is to provide for a unitary panty hose garment wherein a reinforced and fashionable appearance is imparted to the garment by controlling the denier of the yarn utilized during the construction of the garment.

Another object is to provide a panty hose garment constructed so as to impart to the wearer's leg a fashionable hose-dressed appearance which is desirable on certain occasions and/or with certain styles of outer garments.

BRIEF SUMMARY OF THE INVENTION

The foregoing objects and other features and advantages are attained by a body under garment such as panty hose having a pants portion and integrally formed leg portions. In accordance with this invention the leg portions of the garment are formed with a reinforcing area or band which is adapted to circumscribe a portion of the wearer's thighs when the garment is fitted to the body. The reinforcing band is integrally formed as an integral part of the garment and is disposed at the juncture between the upper end of the leg portion and the lower end of the pants portion. The area or band is strengthened by forming the same of a yarn having a denier which is greater than the denier of the yarn making up the leg portion of the garment. The arrangement is such that the reinforced area formed of a yarn having a greater denier further imparts to the leg portion of the garment a stylized fashionable look of a hose-dressed leg when the garment is worn and which look or appearance is highly desirable with the fashion of certain outer garments.

FEATURES

A feature of this invention resides in the provision of an improved panty-hose type garment which is integrally formed with a reinforced area located to facilitate the fitting of the leg portion of the garment to the legs of the wearer.

Another feature resides on the provision wherein the reinforced area imparts a highly desirable fashion appeal to the garment.

Another feature of the invention resides in the provision that the reinforced area and desired fashionable appeal is achieved by the size of yarn denier utilized in the construction of the garment.

Other features and advantages will become more readily apparent when considered in view of the drawings and specifications in which:

FIG. 1 is a side view of a body garment embodying the present invention.

DETAIL DESCRIPTION

Referring to the drawings, there is shown in FIG. 1, a body garment illustrated in the form of a panty hose 10. The panty hose 10 comprises a pants portion 11 and a pair of connected leg portions 12—12. The respective leg portions 12—12 are integrally connected to the pants portion 11 so that the entire garment comprises a unitary construction.

The respective leg portions 12—12 each include a foot portion **12*a* and a connected leg portion 12*b* and thigh portion 12*c*. To provide an area of reinforcement of sufficient tensile strength or stress to facilitate the wearer in stretching or fitting the respective leg sections 12*b* to her legs when the garment is fitted, a reinforcing band 13 is integrally formed so as to circumscribe the thigh portion of a wearer's leg. The reinforcing band 13 is formed during the construction of the panty hose 10 by utilizing a yarn of a denier size greater than that of the yarn used to construct the leg section 12*b*. To impart the desired sheer effect to the leg portion or section 12*b*, an eighteen (18) denier yarn may be used. To form the reinforced band 13, a forty (40) denier yarn can be used. The pants portion 11** may, if desired, be given the sheer look of the leg portion by forming it of an eighteen (18) denier yarn.

It will be noted that using a heavier denier yarn to construct the band area 13, the band provides a reinforced area which is capable of withstanding the pull, tug, or stretch necessary for a wearer to pull the leg section and shape the same to her legs. Also, to enhance the styling or appearance of the panty hose 10, the reinforced band is located in that area of the thigh, when worn, the reinforced yarn will simulate the welt or hem of a conventional known "silk" or "nylon" stocking.

To further simulate the stocking look, when the panty hose 10 is worn, a shadow welt band 14 may be formed adjacent to the lower edge of the reinforcing band 13. The shadow welt band 14 is formed by utilizing a yarn having a denier size which is less than that of band 13 and greater than that of the leg section 12*b*. As conventional stockings have such shadow welt, the panty hose 10 is shown with a simulated shadow welt 14 so as to even more closely simulate the high fashionable appearance of a hose-dressed leg when the garment 10 is worn. If the yarn denier of the leg section is 18 and the denier of the band 13 is 40, a denier of 20 would be suitable for the shadow welt band 14.

Another area of reinforcement to withstand the stress of pulling and tugging when fitting the garment to one's body is at the waist or upper portion 15 of the pants portion 11. Accordingly, the reinforced waist band is formed by making this area of a yarn having a denier greater than the yarn denier of the pants portion 11. If desired, the waist portion or band 15 may be made of the same denier used to form the shadow welt band 14. An elastic upper belt or waist band 16 defines the uppermost hem of the panty hose 10.

If desired, the toe and heel portions 17 and 18 of the respective foot portions 12*a*, 12*a* may be reinforced.

From the foregoing, it will be noted that the panty hose 10 is provided with distinct reinforced area viz. the thigh band area 13, 13 circumscribing the thighs of the wearer, and a reinforced waist band 15. In fitting such a garment to one's body, the wearer can first shape the leg portion 12—12, to her respective legs by inserting a leg one at at time into the respective leg portion of the panty hose, and grasping the welt or band portion 13, reinforced as described, to form or pull the leg portion of the hose onto her leg. As the reinforcing band 13 is of sufficient strength, danger of tearing or running the hose portion in pulling the leg portion onto the leg of the wearer is minimized. The pants portion 11 is snugly pulled over the body of the wearer by grasping the reinforced waist band 15.

With the panty hose properly fitted to one's body, the reinforced welt or band 13 about the thigh simulates the upper end of a conventional hose, thereby providing the panty hose with a stylized or high fashion appearance which is highly desirable for wear with certain types of styled outer garments. It will be noted that the described panty hose incorporates a construction which is achieved by controlling the yarn denier during fabrication so as to impart reinforced area which facilitates the fitting of the garment to one's body and which when fitted provides a fashionable appearance not otherwise attainable in a unitary type garment.

The panty hose described thus provides the wearer with the comfort, freedom and smooth look of a panty hose; facilitates the task of fitting and stretching the panty hose to one's body and when fitted, gives the desired appearance of a "Fashion Hose" leg dress.

It will be noted that the leg portion 12*b* and lower thigh portion and pants portion can be made as sheer as desired with the reinforcing bands 13 and 15 and shadow welt 14 being made of contrasting sheer by varying the yarn denier of the respective component sections during the construction of the garment.

While the invention has been described with respect to a particular embodiment thereof, variations and modifications may be made without departing from the spirit or scope of the invention.

What is claimed is:

1. A panty hose construction for facilitating the stretching and shaping of the panty hose so as to snuggly conform the panty hose to the shape of the wearer's body with a minimum of risk in snagging or running the panty hose when putting on said hose and for imparting a fashionable look to said hose when worn comprising a pants portion and a pair of connected leg portions integrally connected to said pants portion so as to define a smooth unitary and integrally formed panty hose, each of said leg portions including a foot section having a connected toe and heel portion and a leg section connected to said foot section; said leg section extending beyond the knee and to a substantially mid-portion of the thigh; a wide reinforcing thigh band of single ply defining the upper end of the leg section and which is arranged to circumscribe the said mid-thigh portion of the thigh; said reinforcing thigh band being integrally formed of a yarn having a denier greater than the denier of the yarn forming said leg section, said reinforcing wide thigh band providing an intermediate reinforced area for the wearer to grasp said thigh band without grasping said adjacent leg and pants portion for stretching and shaping the respective leg portion to the wearer's legs in the fitting of said hose to the wearer's body with a minimum of risk in snagging or running said hose, and said pants portion extending from the top of said reinforcing thigh band disposed at substantially the mid portion of the wearer's thigh to the waist of the wearer, and a reinforced waist band circumscribing the upper end of said pants portion.

2. A panty hose as defined in claim 1 and including a shadow welt band of single ply interposed between said reinforcing band and said leg section whereby said shadow welt band is formed of a yarn having a denier size which is greater than the denier of said leg section and less than the denier yarn of said reinforcing band for imparting a high fashion hose dress look to the leg of the wearer.

* * * * *